US008116653B2

(12) United States Patent
Kondo et al.

(10) Patent No.: US 8,116,653 B2
(45) Date of Patent: Feb. 14, 2012

(54) AERATOR AND IMAGE FORMING APPARATUS WHICH RESTRAINS AIR FROM FLOWING TO A HEAT GENERATING OBJECT

(75) Inventors: Hitoshi Kondo, Saitama (JP); Masahito Shikata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1125 days.

(21) Appl. No.: 11/872,242

(22) Filed: Oct. 15, 2007

(65) Prior Publication Data

US 2008/0219693 A1 Sep. 11, 2008

(30) Foreign Application Priority Data

Feb. 28, 2007 (JP) ..... 2007-049573

(51) Int. Cl.
*G03G 21/20* (2006.01)

(52) U.S. Cl. ..... 399/92

(58) Field of Classification Search ..... 399/92, 399/93; 361/679.46–679.51, 688
See application file for complete search history.

(56) References Cited

U.S. PATENT DOCUMENTS 5,164,778 A * 11/1992 Tanabe et al. ..... 399/93
2003/0128510 A1* 7/2003 Anzai et al.
2007/0059009 A1* 3/2007 Nakayama

FOREIGN PATENT DOCUMENTS

JP 11-095644 A 4/1999

* cited by examiner

*Primary Examiner* — David Gray
*Assistant Examiner* — Laura Roth
(74) *Attorney, Agent, or Firm* — Sughrue Mion, PLLC

(57) ABSTRACT

An aerator includes a ventilating member that opposes a heat generating object and through which air flows, and an inlet device that takes in air from an outside and sends the air to the ventilating member. The ventilating member includes a discharging portion that discharges the air flowing through the ventilating member to the outside, an opening through which heat generated by the heat generating object enters the ventilating member, and a restraining portion that restrains the air taken in by the inlet device from flowing to the heat generating object through the opening.

7 Claims, 14 Drawing Sheets

AERATOR AND IMAGE FORMING APPARATUS WHICH RESTRAINS AIR FROM FLOWING TO A HEAT GENERATING OBJECT

CROSS-REFERENCE TO RELATED APPLICATIONS

This application is based on and claims priority under 35 U.S.C. 119 from Japanese Patent Application No. 2007-049573 filed Feb. 28, 2007.

BACKGROUND

1. Technical Field

The present invention relates to an aerator and an image forming apparatus.

2. Related Art

There is a known image forming apparatus comprising: a fixing unit which is disposed in the body of the image forming apparatus, and through which a recording medium after an image formed on an image carrier is transferred is passed, whereby the transferred image on the recording medium is heated and fixed; a ventilating duct which is disposed between the fixing unit and another image forming unit disposed in the apparatus body, with forming a heat discharging hole on the side of the fixing unit; and an aerating fan which sucks air from the heat discharging hole to send the air to the inside of the ventilating duct.

SUMMARY

According to an aspect of the present invention, an aerator includes: a ventilating member that is disposed opposedly to a heat generating object, and that allows air to flow through an inside; and an inlet device that takes in air from an outside, and that sends the air to the ventilating member, the ventilating member including: a discharging portion that discharges the air flowing through the ventilating member to the outside; an opening through which heat generated by the heat generating object is taken in the ventilating member; and a restraining portion that restrains the air taken in by the inlet device from flowing to the heat generating object through the opening.

BRIEF DESCRIPTION OF THE DRAWINGS

Exemplary embodiment of the present invention will be described in detail based on the following figures, wherein:

FIGS. 9A and 9B are section views showing the state of the moving member used in the second embodiment of the invention, wherein FIG. 9A is a section view showing the state of the moving member used in the second embodiment of the invention, in the case where the inlet device is operated, and FIG. 9(*b*) is a section view showing the state of the moving member in the case where the inlet device is stopped;

DETAILED DESCRIPTION

Next, embodiments of the invention will be described with reference to the accompanying drawings.

Figure 1:
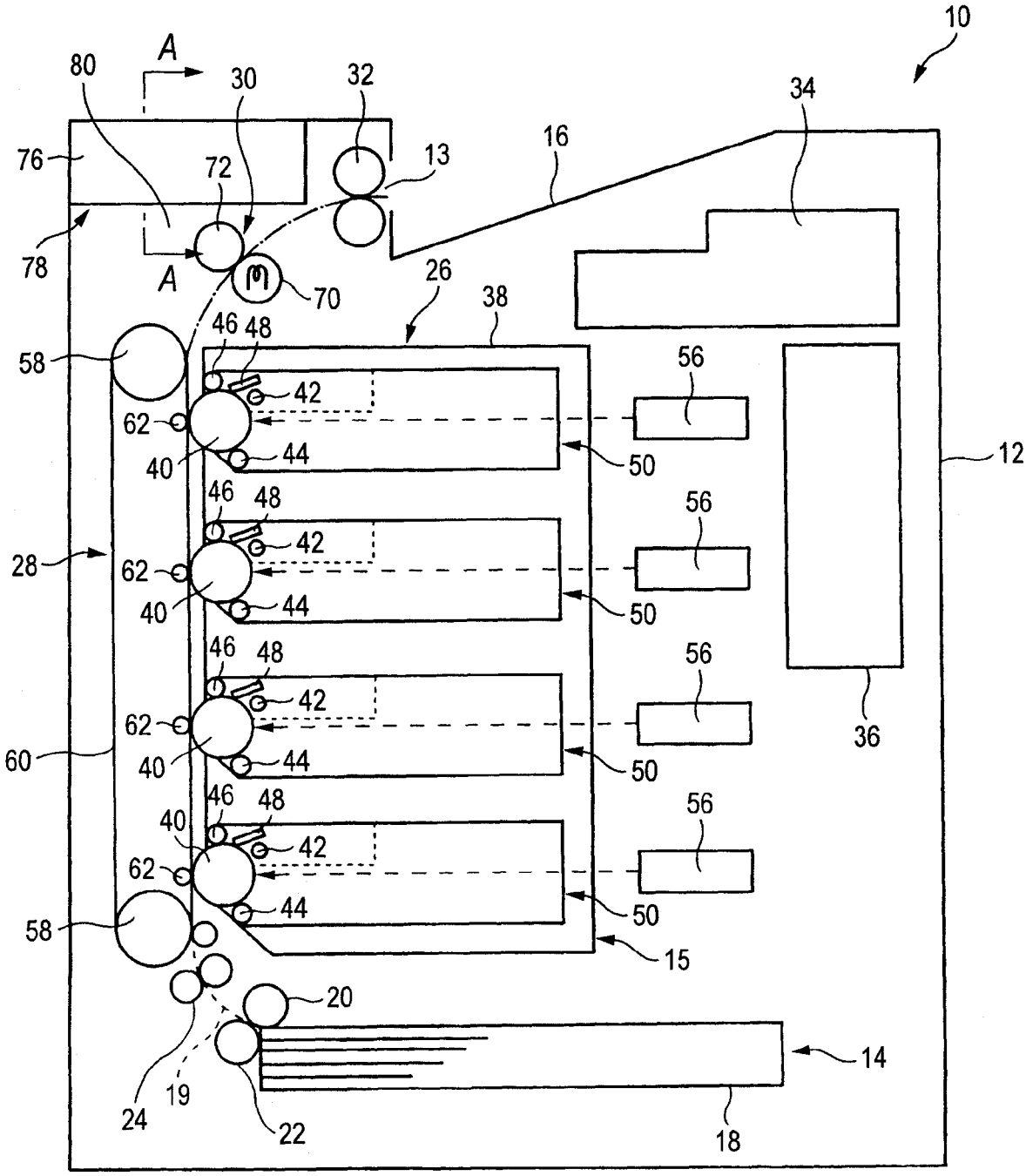
FIG. 1 is a side view schematically showing the configuration of an image forming apparatus of a first embodiment of the invention.

FIG. 1 shows an image forming apparatus 10 of an embodiment of the invention. The image forming apparatus 10 has an image forming apparatus body 12. In the image forming apparatus body 12, a sheet supplying device 14, an image forming portion 15, a power supply unit 34, a control unit 36, and a fixing device 30 used as a heat generating object are mounted, and a conveyor path 19 for conveying a sheet used as a recording medium is formed. In the image forming apparatus body 12, a discharge port 13 is formed. An upper portion of the image forming apparatus body 12 is used as a sheet discharge portion 16 to which a sheet that has undergone an image forming process is discharged.

The image forming portion 15 has a photosensitive member unit 26 used as an image forming unit, an optical writing device 56, and a transfer unit 28, and is used for forming a developer image on a sheet. The photosensitive member unit 26 is detachably attached in the image forming apparatus body 12, and provided with a photosensitive member unit body 38. In the photosensitive member unit body 38, for example, four subunits 50 are disposed in such a manner that they can be attached to and detached from the photosensitive member unit body 38.

Each of the subunits 50 has a photosensitive member 40 used as an image carrier. Around the photosensitive member 40, disposed are: a charging device 42 comprising a charging roll which uniformly charges the photosensitive member 40, and which is used as charging means; a developing device 44 which develops a latent image written on the photosensitive member 40 by a developer (a toner), and which is used as developing means; a discharging device 46 used as discharging means for discharging the photosensitive member 40 by irradiating the photosensitive member 40 with light after the transfer of the developer image; and a cleaning device 48 which removes a developer remaining on the photosensitive member 40 after the transfer, and which is used as developer removing means.

The four subunits 50 are used for respectively forming a yellow developer image, a magenta developer image, a cyan developer image, and a black developer image, in the order from the upstream of the sheet conveying direction, i.e., from the lower portion in the gravity direction. The subunits form a yellow developer image, a magenta developer image, a cyan developer image, and a black developer image, on the surfaces of the photosensitive members 40, respectively.

Each of the optical writing devices 56 is configured by a laser exposing device. The optical writing devices are arranged on the back side of the photosensitive member unit 26 and in positions corresponding to the photosensitive members 40, respectively, and irradiate the photosensitive members 40 which are uniformly charged, with laser light, thereby forming latent images.

The transfer unit 28 is positioned on a front side of the photosensitive member unit 26 (on the left side of FIG. 1), and disposed opposedly to the photosensitive member unit 26. The transfer unit 28 has two supporting rolls 58, 58 which are vertically arranged, and a conveyor belt 60 is looped around the two supporting rolls 58, 58. At least one of the two supporting rolls 58, 58 is used as a driving roll for transmitting a driving force to the conveyor belt 60. In response to the driving transmission from the driving roll, the conveyor belt 60 is rotated.

The transfer unit 28 has four transfer rolls 62 which are disposed so as to be opposed to the photosensitive members 40 across the conveyor belt 60. Transfer biases are applied to the transfer rolls 62, respectively, thereby transferring the developer images formed on the photosensitive members 40 to the sheet.

The fixing device 30 has a heat roll 70, and a pressure roll 72 which is in pressure contact with the heat roll 70. The fixing device is used for fixing the images (developer images) which are transferred onto the sheet by the transfer rolls 62, by heating and pressurizing the images in a portion where the heat roll 70 is in contact with the pressure roll 72.

The sheet supplying device 14 has a sheet container 18. In the sheet container 18, sheets are stackingly stored. In one upper end portion of the sheet container 18, a feed roll 20 is disposed, and a separation roll 22 is disposed opposedly to the feed roll 20. A sheet which is in the top in the sheet container 18 is picked up by the feed roll 20, and the sheet is separated and transported by the cooperation of the feed roll 20 and the separation roll 22.

The conveyor path 19 is a sheet path extending from the sheet container 18 to the sheet discharge portion 16. Along the conveyor path 19, in the order from the lower side in the gravity direction, i.e., from the upstream in the sheet conveying direction to the upper side in the gravity direction, i.e., to the downstream in the sheet conveying direction, the feed roll 20, the separation roll 22, a registration roll 24, the transfer unit 28, the fixing device 30, and sheet discharge rolls 32 used as a sheet discharge device are disposed. The resist roll 24 temporarily stops the leading end of the sheet, and then starts the conveyance of the sheet to the downstream in synchronization with the timing of the forming of the developer images in the photosensitive member unit 26. The sheet discharge rolls 32 transport and discharge the sheet on which the developer images are fixed by the fixing device 30, to the sheet discharge portion 16 via the discharge port 13.

In the image forming apparatus body 12, an aerator 78 is disposed in a position above the fixing device 30 and between the image forming apparatus body 12 and the fixing device 30. The aerator 78 has a duct 76 used as a ventilating member, and an inlet device which will be described later. The aerator is used for intaking heat generated by the fixing device 30 into the duct 76 through a space 80 on the side where the fixing device is disposed, and then discharging the heat taken in the duct 76 to the outside. The aerator 78 and the duct 76 will be described later in detail.

In the thus configured image forming apparatus 10, the photo sensitive member 40 is uniformly charged by the charging device 42, and a latent image is formed on the uniformly-charged photosensitive member 40 by the optical writing device 56. The latent image is visualized with the developer by the developing device 44, thereby forming a developer image. The developer images formed on the photosensitive members 40 are sequentially transferred to the sheet in the order from the developer image formed on the photosensitive member 40 positioned below, by the transfer rolls 62 of the transfer unit 28. Then, the developer images transferred to the sheet are fixed to the sheet by the fixing device 30.

Figure 2:
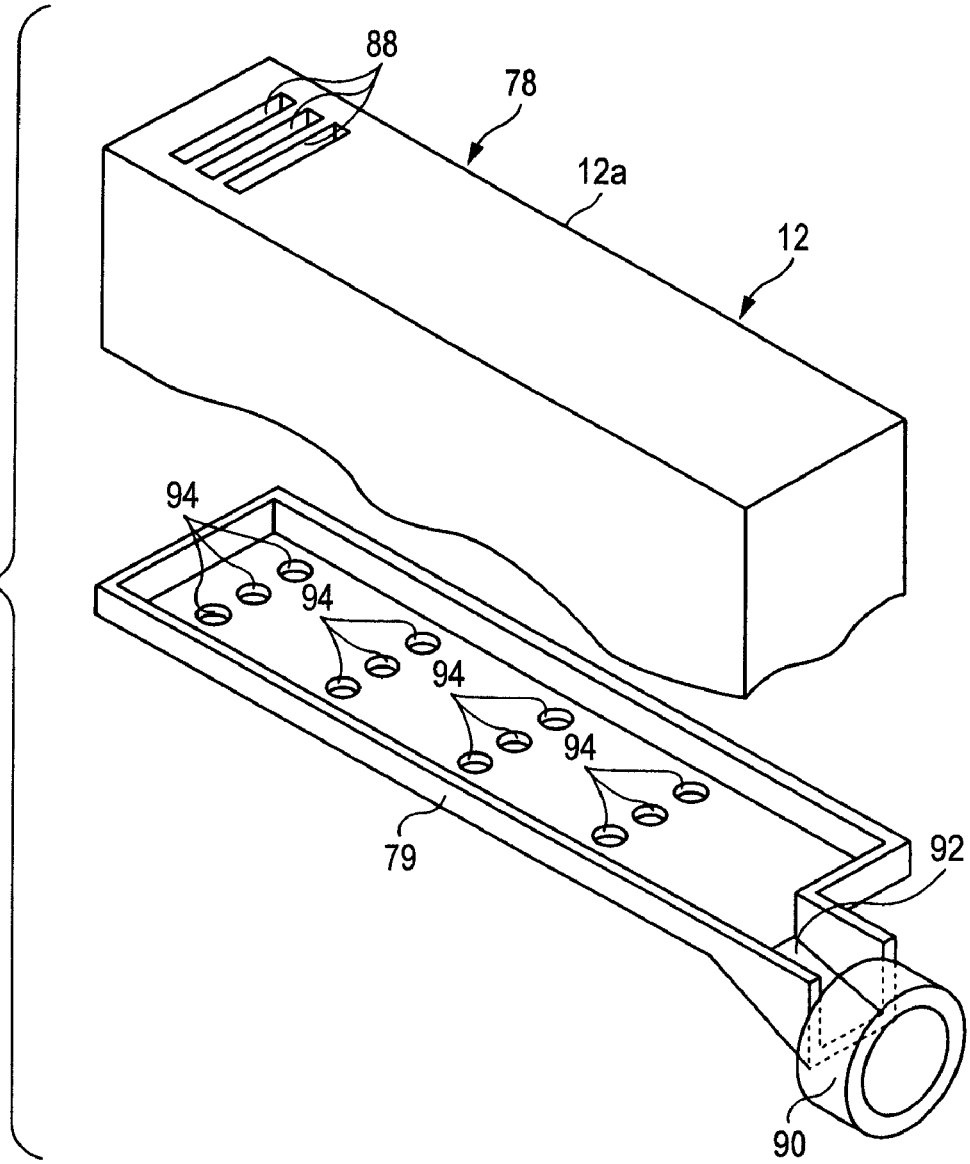
FIG. 2 is an exploded perspective view showing a duct used in the first embodiment of the invention.
Figure 3:
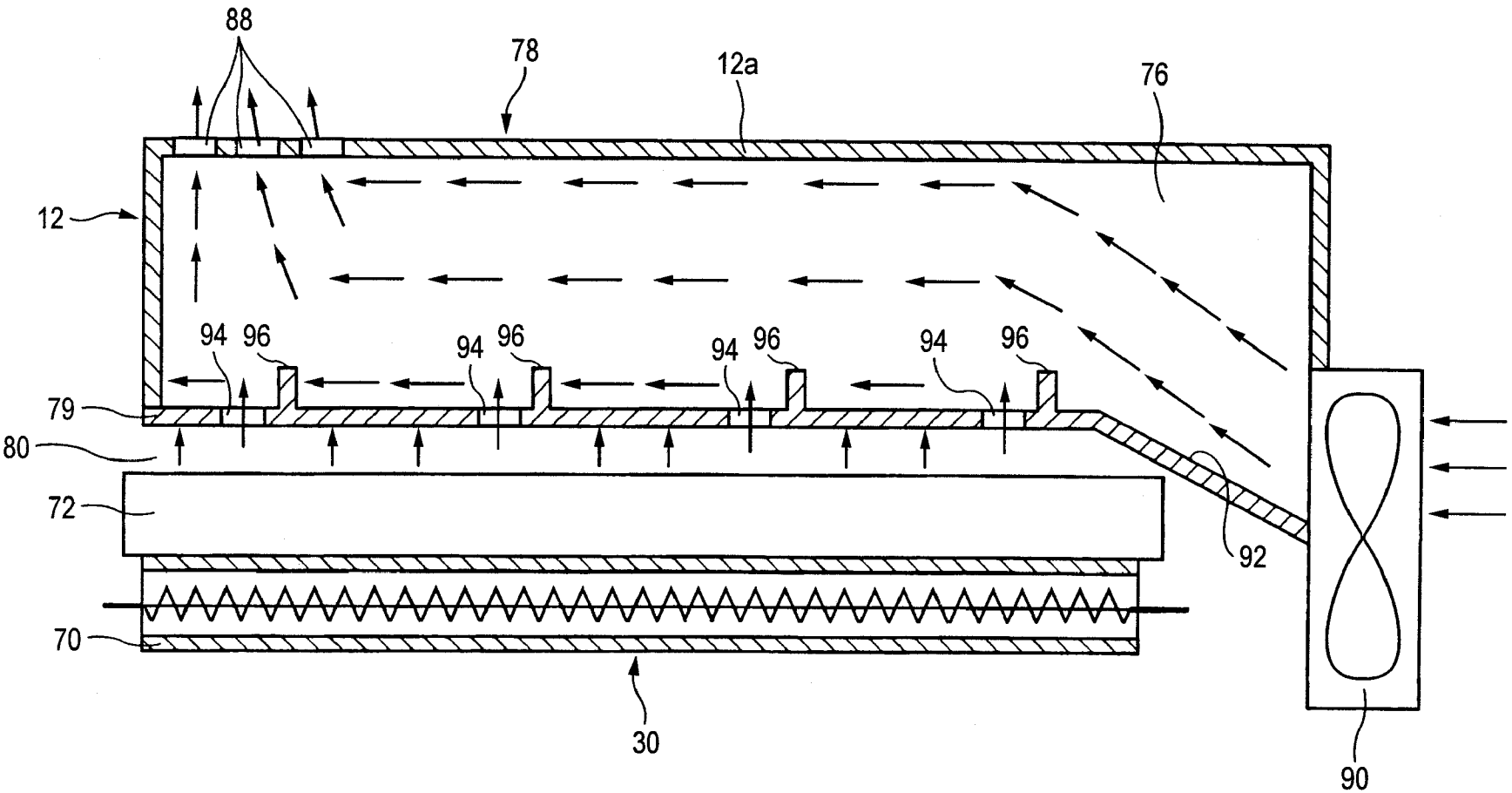
FIG. 3 is a section view showing the duct used in the first embodiment of the invention taken along a line A-A in FIG. 1.

FIGS. 2 and 3 show the aerator 78. FIG. 2 is an exploded perspective view of the aerator 78, and FIG. 3 is a section view of the aerator 78. The aerator 78 has the duct 76 used as the ventilating member, and an inlet device 90 connected to the duct 76. The duct 76 is disposed opposedly to the fixing device 30, and enclosed so as to allow air to flow through the inside, and a space is formed inside the duct. The duct 76 is formed by fitting a plate-like member 79 in a downward opening of an upper cover 12*a* which is a part of the image forming apparatus body 12. The duct is formed so as to extend from the side of the right side face of the image forming apparatus 10 (the front side in FIG. 1) to the side of the left side face of the image forming apparatus 10 (the back side in FIG. 1) along the axial direction of the heat roll 70 and the pressure roll 72. It is a matter of course that the downward opening of the upper cover 12*a* and the plate-like member 79 can be disposed in close contact with each other so as to form a cylindrical duct 76. Alternatively, they may be disposed not closely in contact with each other but disposed opposedly, so as to form a duct 76 in which a slight gap exists around the plate-like member 79.

The duct 76 has a discharge opening 88 used as a discharge port. For example, the discharge opening 88 is formed in a position on the side of the left side face of the image forming apparatus 10 in the upper face of the upper cover 12*a*. The discharge opening is used for discharging the air in the duct 76 to the outside of the duct 76, and for discharging the air to the outside of the image forming apparatus body 12.

The inlet device 90 is connected to the duct 76 so as to be attached to, for example, the right side of the plate-like member 79, and used for intaking air from the outside of the duct 76 into the duct 76, and for sending the air taken in the duct 76 through the duct 76. When the inlet device 90 is driven, and the intake of air into the duct 76 is performed, an air flow from the inlet device 90 to the discharge opening 88 is produced, as shown by the arrows in FIG. 3. Then, due to the air flow, the upper cover 12*a* heated by the heat generated by the heat roll 70 of the fixing device 30 is cooled.

On the left side of the position of the plate-like member 79 where the inlet device 90 is attached, a slope 92 which is higher as more advancing from the right side to the left side is formed. The slope 92 is used as a restraining portion and also used as a guide plane. The slope guides the air taken in by the inlet device 90 to the side opposite to the fixing device 30, i.e., to the upper side. Since the air is guided upwards by the slope 92, the air stream is hit on the upper portion of the upper cover 12*a*. Thus, the upper portion of the upper cover 12*a* is cooled by the air stream.

The duct 76 has an opening 94. The opening 94 is used for intaking the heat generated by the fixing device into the duct 76. For example, a plurality of openings 94 are formed in the plate-like member 79. Each opening 94 has a substantially circular shape, for example, for communicating the inside of the duct 76 with the space 80 (see FIG. 1) on the side where the fixing device 30 is disposed. In the case where the openings 94 are not formed, the space 80 and the inside of the duct 76 are not communicated with each other, so that the heat generated by the heat roll 70 is hardly moved to the inside of the duct 76. Thus, the heat generated by the heat roll 70 stays in the space 80, and there is a possibility that the heat release from the fixing device 30 is not well performed. In the embodiment, the heat generated by the fixing device 30 is moved to the inside of the duct 76 via the openings 94.

The duct 76 has walls 96 used as restraining portions (see FIG. 3). The walls 96 are formed so as to be respectively around the openings 94 raised from the plate-like member 79 in the duct 76. For example, the walls are formed on the side of the inlet device 90 which is the upstream side of the air flow with respect to the respective openings 94. In FIG. 2, the openings 94 will be hidden in the figure, and therefore the walls 96 are omitted in the figure.

Figure 4:
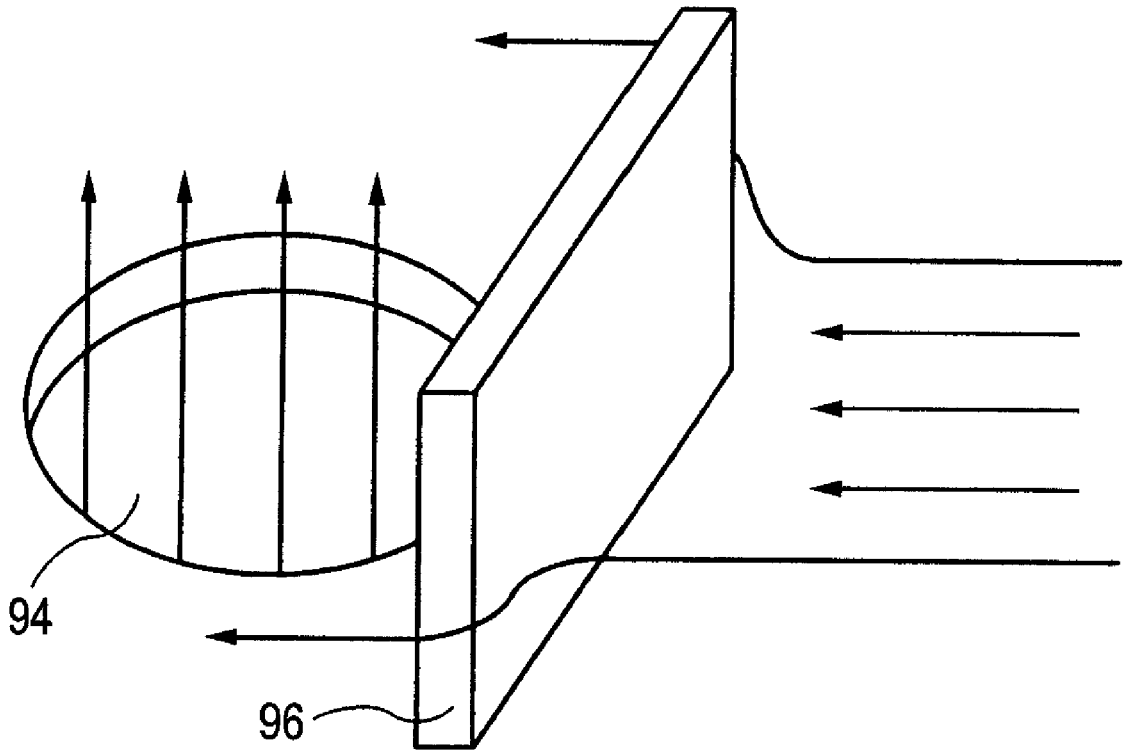
FIG. 4 is a perspective view showing a wall used in the first embodiment of the invention.

FIG. 4 is an enlarged view showing one of the walls 96. For example, the number of the walls 96 is the same as that of the openings 94. In the case where the walls 96 are not disposed, there is a possibility that the air taken into the duct 76 by the inlet device 90 easily flows to the side of the fixing device 30 from the inside of the duct 76 via the openings 94. When the air flows from the inside of the duct 76 to the side of the fixing device 30, this air flow causes heat generated by the fixing device 30 to be hardly moved into the duct 76.

In the embodiment, as shown by the arrows of FIG. 4, the air flows to the openings 94 are blocked by the walls 96, and the directions thereof are changed, so that the air flows pass around the sides of the openings 94. As shown by the arrows in FIG. 4, the heat is moved from the side of the fixing device 30 to the side of the duct 76 via the openings 94, in such a manner that, for example, the heated air is moved upwards.

Figure 5:
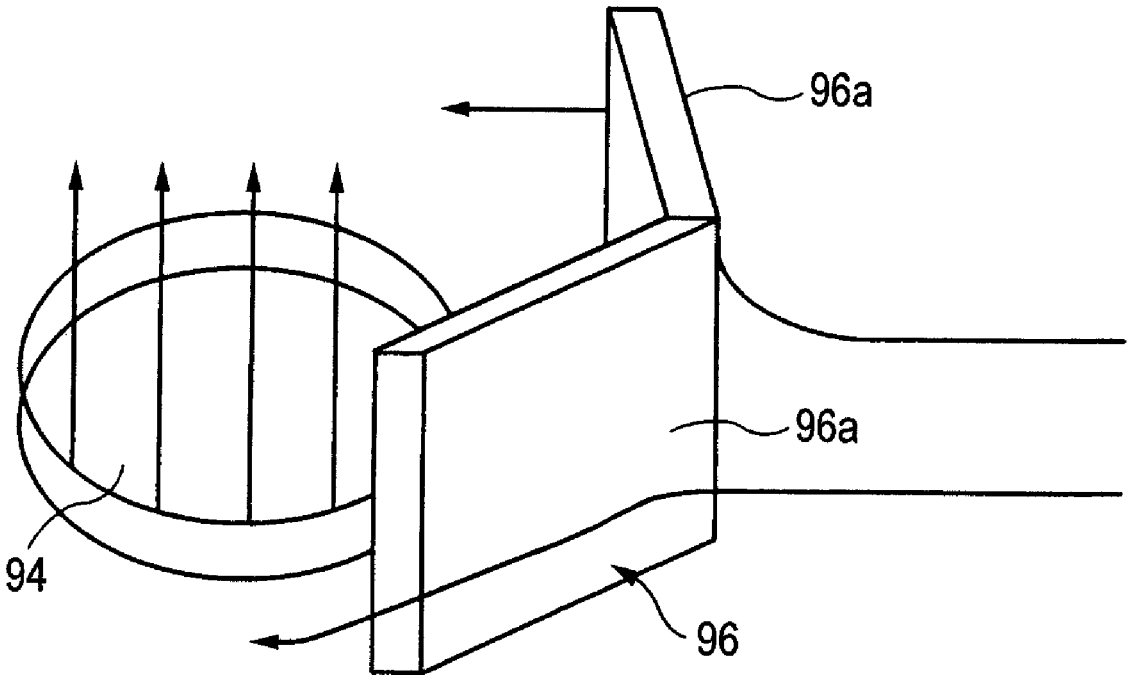
FIG. 5 is a perspective view showing a modification of the wall used in the first embodiment of the invention.

FIG. 5 shows a modification of the wall 96. In the modification, walls 96*a*, 96*a* are formed so as to be inclined with respect to the air-flow direction in the duct 76. In the duct 76, as shown by the arrows in FIG. 5, the air flows in a direction separating from the opening 94 along the walls 96*a*, 96*a*.

Figure 6:
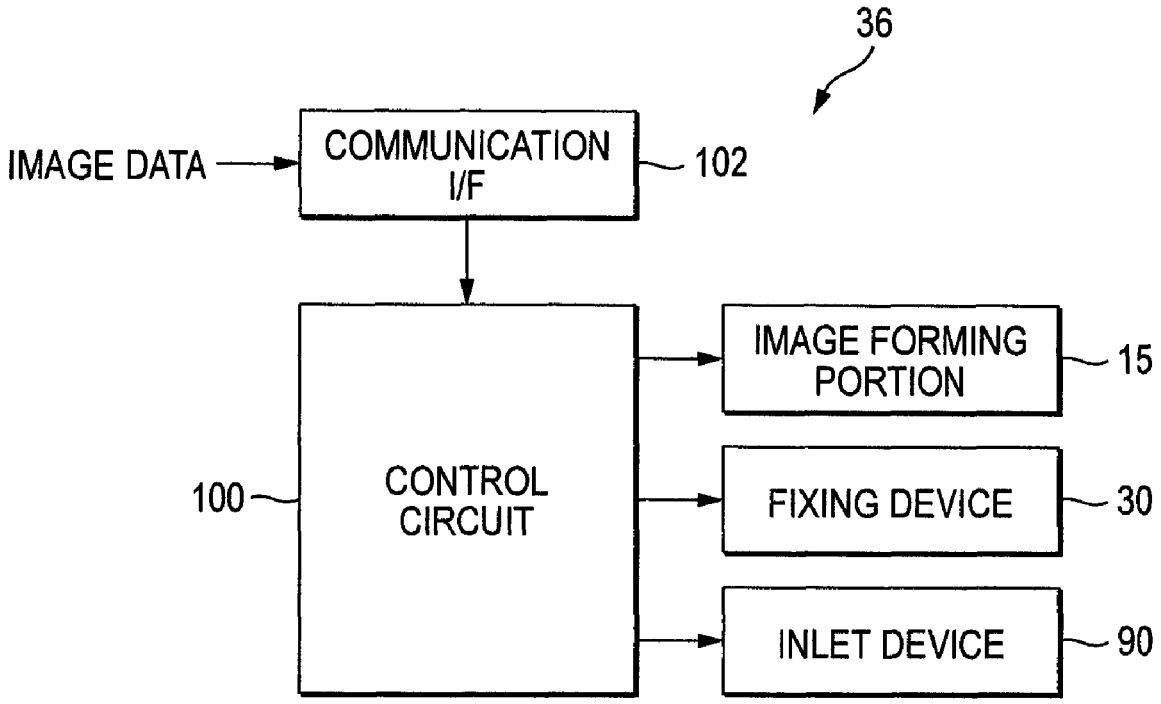
FIG. 6 is a block diagram showing a control portion used in the first embodiment of the invention.

FIG. 6 shows the control unit 36.

The control unit 36 has a control circuit 100 used as a control portion. Image data are input into the control circuit 100 via a communication interface 102. The image forming portion 15, the fixing device 30, and the inlet device 90 are controlled by the output from the control circuit 100.

Figure 7:
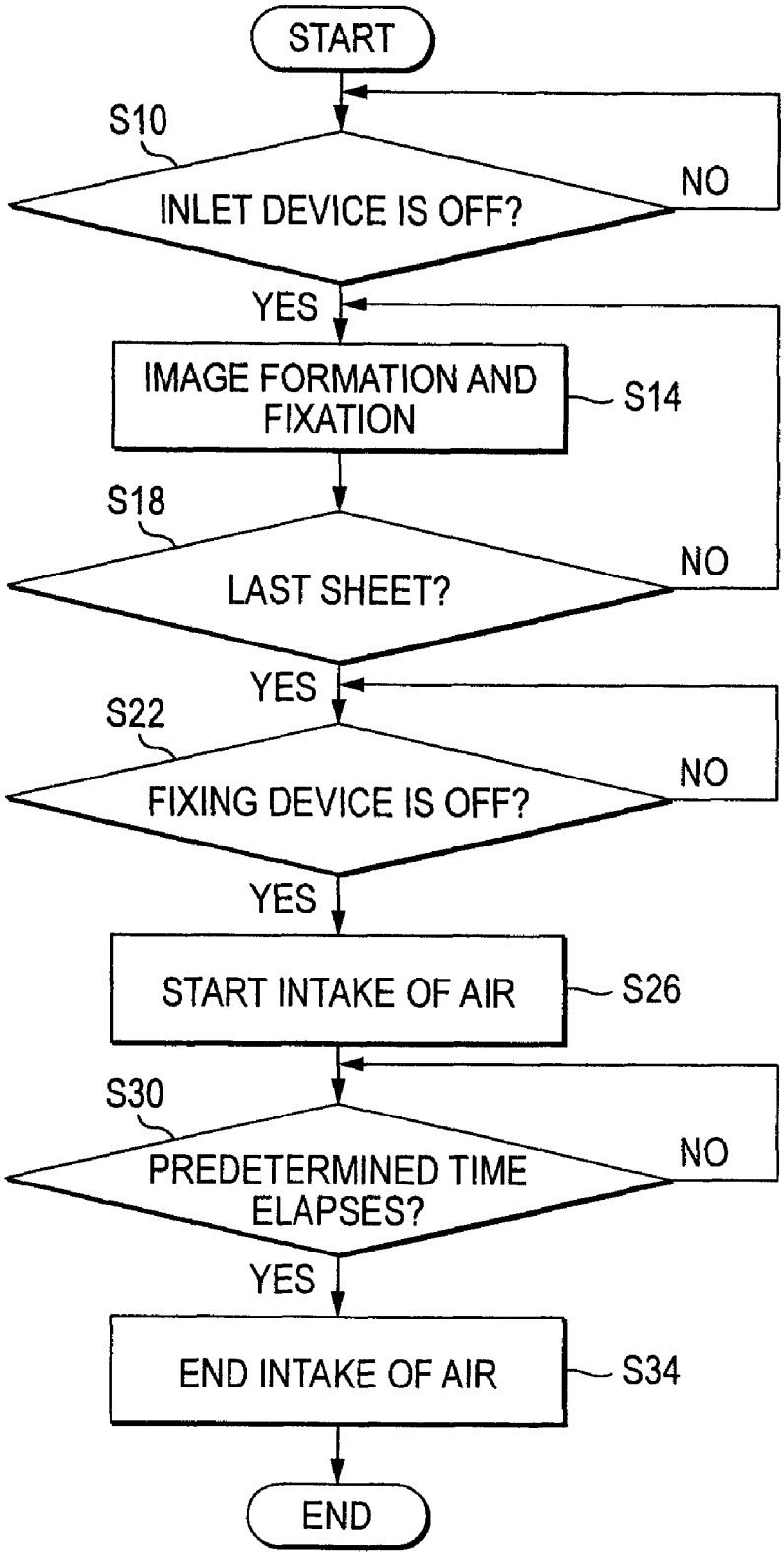
FIG. 7 is a flowchart illustrating the operation of a fixing device and an inlet device used in the first embodiment of the invention.

FIG. 7 shows a control flow of the control unit 36.

First, it is checked in step S10 whether the driving of the inlet device 90 is in an OFF state or not. If it is checked that the inlet device 90 is in the OFF state, the control circuit 100 controls in next step S14 the image forming portion 15 to perform image forming on a sheet (forming of a developer image), and controls the fixing device 30 to fix the image (developer image) formed on the sheet by the image forming portion 15, onto the sheet. In the embodiment, the fixing device 30 is driven in a state where the inlet device 90 is stopped, so that, during the driving of the fixing device 30, the heat generated by the fixing device 30 can be moved to the duct 76 without being impeded by the air flow generated by the inlet device 90.

When it is checked in next step S18 that the sheet on which an image is formed is the last sheet in this series of image forming operations, it is checked in next step S22 whether the fixing device 30 is in the OFF state or not. After it is checked that the fixing device is in the OFF state, the control circuit 100 starts in step S26 the driving of the inlet device 90, thereby starting the intake of air into the duct 76. In the embodiment, in response to the stopping of the fixing device 30, the control circuit 100 starts the driving of the inlet device 90. Even when a state where the upper cover 12*a* is heated by the heat from the fixing device 30 occurs, therefore, the upper cover 12*a* is cooled by the air which is taken by the inlet device 90 and discharged from the discharge opening 88, after the fixing device 30 is stopped.

After it is checked in next step S30 that a predetermined time elapses from the start of the driving of the inlet device 90, the control circuit 100 stops the inlet device 90, thereby terminating the intake of air. The predetermined time of step S30 is determined depending on, for example, the number and the size of sheets on which images are formed in step S14, and determined as a time period in which the upper cover 12*a* heated in step S14 by the heat generated by the fixing device 30 is sufficiently cooled.

Figure 8:
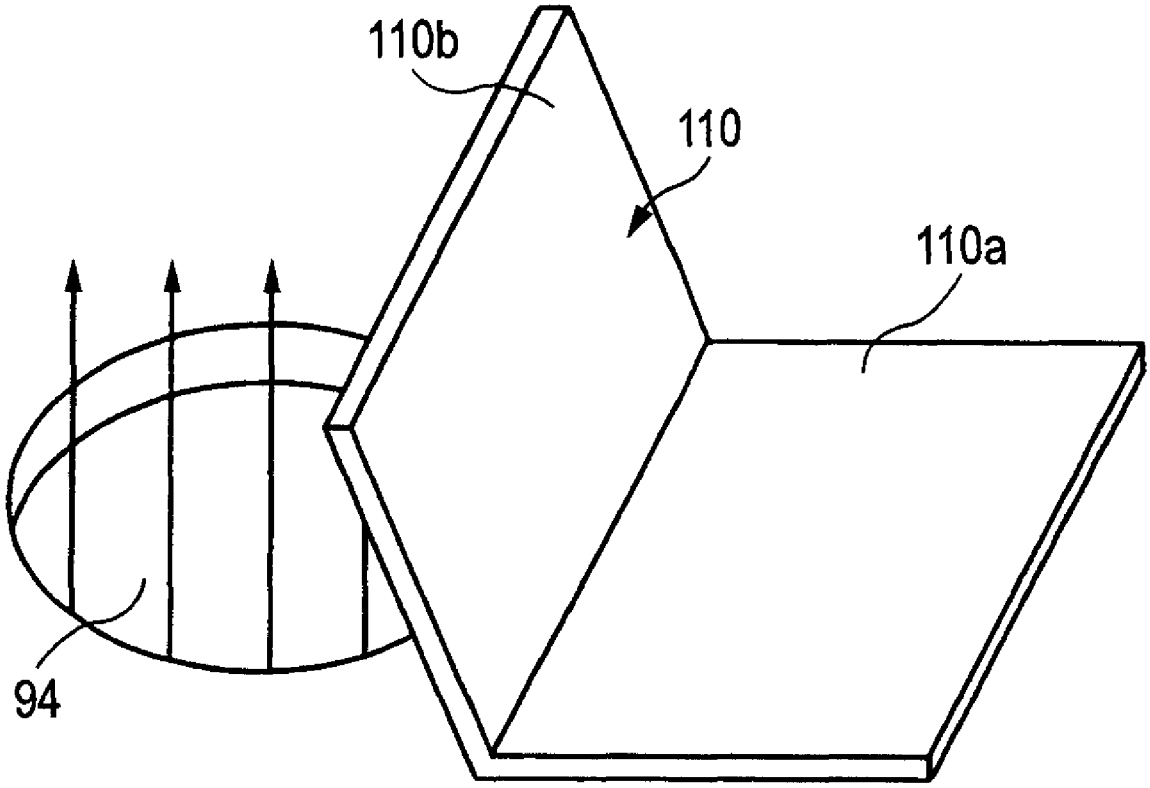
FIG. 8 is a perspective view showing a moving member used in a second embodiment of the invention.

FIG. 8 is an enlarged view of a surrounding portion of an opening 94 of an image forming apparatus 10 which is a second embodiment of the invention. In the above-described first embodiment, the wall 96 is disposed in the position on the side of the inlet device 90 with respect to the opening 94 in the duct 76. By contrast, in the second embodiment, a moving member 110 used as a restraining portion and as a moving portion is disposed in a position on the side of the inlet device 90 with respect to the opening 94 in the duct 76.

The moving member 110 is made of a flexible and elastic material such as a PET film, and, for example, configured as a plate-like member. One end portion 110*a* of the moving member is fixed to a position of the plate-like member 79 on the side of the inlet device 90 with respect to the opening 94. The other end portion 110*b* is extended in a direction above the opening 94 in, for example, a bent manner.

Figure 9A:
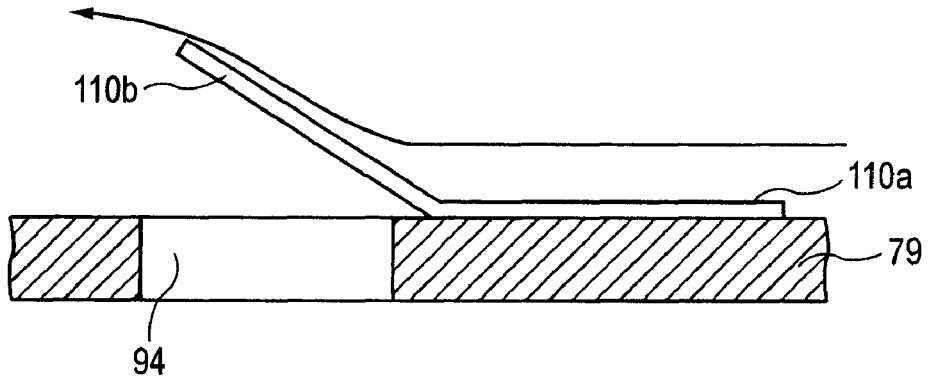
Figure 9B:
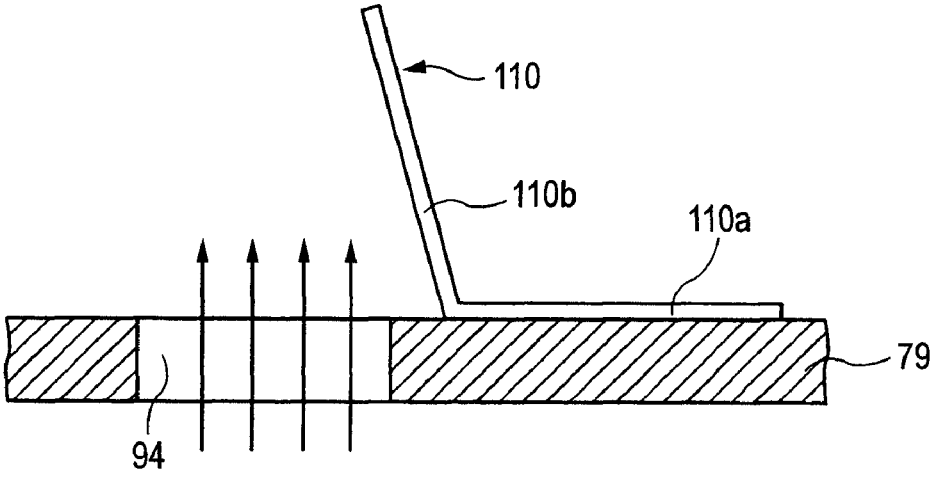

FIG. 9 illustrates the operation of the moving member 110 in the invention.

In a state where the intake of air is not performed by the inlet device 90, as shown in FIG. 9(*b*), the other end portion 110*b* is located in a position for opening the opening 94. When, in this state, the driving of the inlet device 90 (see FIG. 2) is started, the other end portion 110*b* is pushed by the air taken into the duct 76 by the inlet device 90. As shown in FIG. 9(*a*), therefore, the other end portion 110*b* is moved in a direction in which the opening 94 is closed. When the intake of air by the inlet device 90 is stopped, the other end portion 110*b* is moved in a direction in which the opening 94 is opened due to the elasticity, and moved to the initial position shown in FIG. 9(*b*). The second embodiment is identical with the first embodiment except that the moving member 100 is disposed instead of the wall 96, and therefore the description of the other components is omitted.

Figure 10:
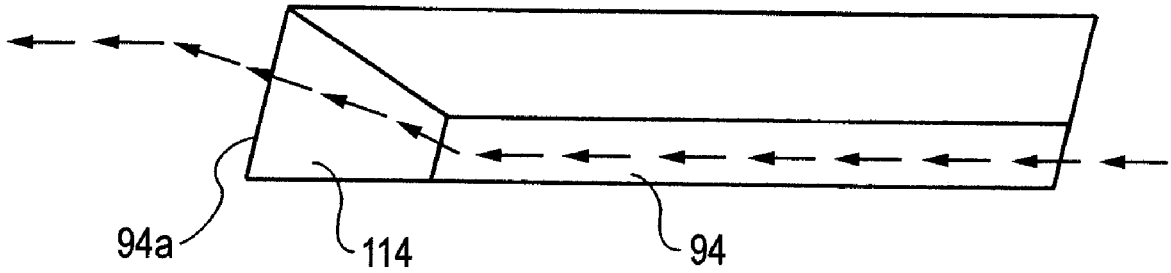
FIG. 10 is a perspective view showing an opening formed in a partition member used in a third embodiment of the invention.

FIG. 10 shows an opening 94 used in a third embodiment of the invention. The openings 94 in the above-described first and second embodiments are substantially circular. In the third embodiment, the opening 94 has a substantially rectangular shape elongated in the air-flow direction. In an edge portion 94*a* of the opening 94 on the downstream side in the air-flow direction, a slope 114 is formed. The slope 114 is higher as more advancing from the right side to the left side, i.e., toward the downstream side of the air-flow direction. Similarly to the above-described slope 92 (see FIGS. 2 and 3), the slope 114 is used as a guide portion for guiding the air taken by the inlet device 90 to the side opposite to the fixing device 30, i.e., toward the upper side. According to the configuration, as compared with the case where the slope 114 is not disposed, the amount of air flowing from the inside of the duct 76 to the side of the fixing device 30 is reduced. The third embodiment is identical with the above-described first embodiment except the shape of the opening 94 and that of the edge portion of the opening 94, and therefore the description of the other components is omitted.

Figure 11:
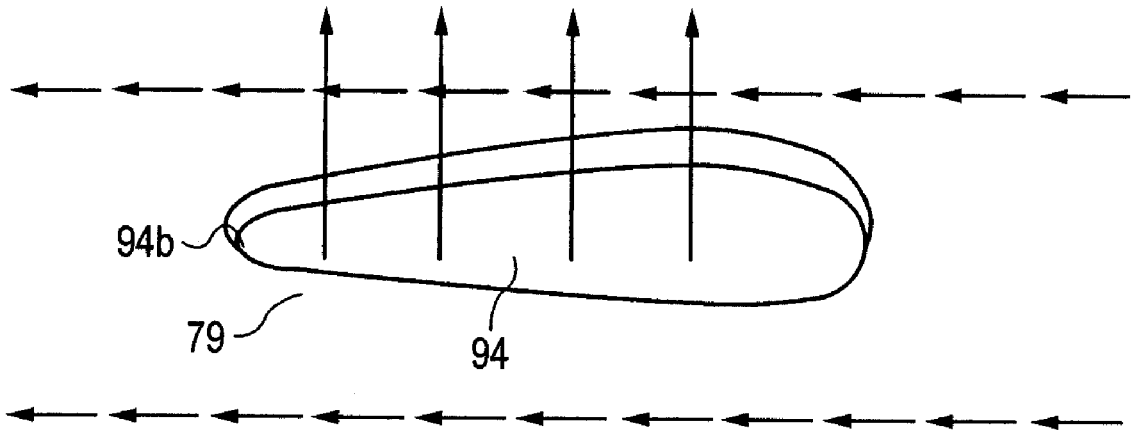
FIG. 11 is a perspective view showing an opening formed in a partition member used in a fourth embodiment of the invention.

FIG. 11 shows an opening 94 used in a fourth embodiment of the invention.

In the above-described first and second embodiments, the openings 94 have the substantially circular shape, and, in the above-described third embodiment, the opening 94 has the substantially rectangular shape. By contrast, in the embodiment, the opening 94 has a shape in which the width is gradually decreased toward the downstream side in the air-flow direction. As compared with the case where the opening 94 having a uniform width in the air-flow direction is used, therefore, the amount of air flowing from the duct 76 to the fixing device 30 is reduced on the side of an end portion 94*b* which is on the downstream side of the air-flow direction. In the embodiment, therefore, the circumferential portion of the opening 94 of the plate-like member 79 is used as a changing portion for changing the shape of the opening 94.

Figure 12:
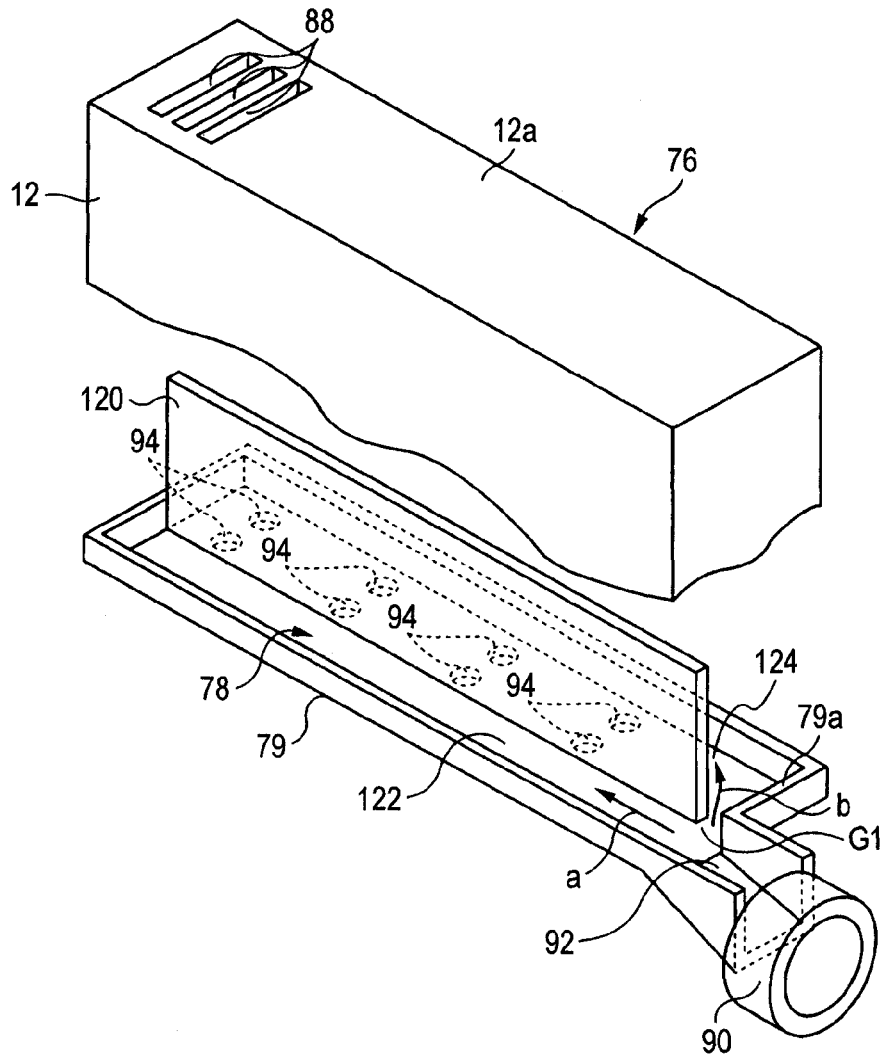
FIG. 12 is an exploded perspective view illustrating a configuration in which a duct is formed in a fifth embodiment of the invention.

FIG. 12 shows a duct 76 used in a fifth embodiment of the invention. In the fifth embodiment, similarly to the above-described first embodiment, the duct 76 is formed so as to be surrounded by the image forming apparatus body 12 and the plate-like member 79. In the duct 76 of the fifth embodiment, a dividing plate 120 which is not disposed in the above-described first to fourth embodiments is disposed. The dividing plate 120 is used as a dividing portion for dividing the space in the duct 76 into a first ventilating path 122 and a second ventilating path 124. For example, the dividing plate 120 has a flat plate-like shape. A right end portion of the dividing plate 120 is not in contact with a rim portion 79*a* of the plate-like member 79 and a right inner side face of the upper cover 12*a*, and a gap G1 is formed between the right end portion, and the upper cover 12*a* and the rim portion 79*a*.

The first ventilating path 122 is disposed on a front side in the duct 76, and on the side of the duct 76 where the inlet device 90 and the slope 92 are disposed in the width direction of the duct 76. The second ventilating path 124 is disposed on the back side of the image forming apparatus 10, and on a side opposite to the side where the inlet device 90 and the slope 92 are disposed in the width direction of the duct 76. The amount of air flowing through the second ventilating path 124 is smaller than that flowing through the first ventilating path 122. Specifically, to the first ventilating path 122, the air taken by the inlet device 90 is guided along the slope 92 as shown by the arrow a in the figure. By contrast, to the second ventilating path 124, as shown by the arrow b in the figure, the air only flows while passing around the dividing plate 120 via the gap G1.

In the above-described first embodiment, the openings 94 are formed in a dispersed manner over the entire surface of the plate-like member 79. By contrast, in the fifth embodiment, the openings 94 are formed on the back side of the plate-like member 79 so as to communicate the inside of the second ventilating path 124 with the space 80 on the side where the fixing device 30 is disposed (see FIG. 1). The openings 94 are not formed on the side of the first ventilating path 122 of the plate-like member 79. Therefore, the second ventilating path 124 is communicated with the space 80 via the openings 94, but the first ventilating path 122 is not communicated with the space 80.

In the thus configured fifth embodiment, when the driving of the inlet device 90 is started, the air from the inlet device 90 is divided so as to flow into the first ventilating path 122 and the second ventilating path 124. The air flowing into the first ventilating path 122 flows through the first ventilating path 122 from the right side to the left side, and the air is discharged from the discharge opening 88. At this time, the air flow in the first ventilating path 122 cools the upper cover 12*a* in which the temperature may be raised by the heat generated by the fixing device 30.

The air flowing into the second ventilating path 124 while passing through the gap G1 flows through the second ventilating path 124 from the right side to the left side, and then discharged from the discharge opening 88. By means of the air flow in the second ventilating path 124, the heat generated by the fixing device 30 and moved into the second ventilating path 124 via the openings 94 is discharged to the outside of the image forming apparatus body 12 via the discharge opening 88. At this time, the amount of air flowing in the second ventilating path 124 is smaller than that in the case where the dividing plate 120 is not disposed, and as compared with the amount of air flowing in the first ventilating path 122. Accordingly, the air flow of the air heated by the fixing device 30 via the openings 94 is hardly impeded.

The above-described fifth embodiment may be combined with at least one or more of the above-described first to fourth embodiments. When the fifth embodiment is combined with the first embodiment, for example, the wall 96 (see FIG. 3) may be disposed on the side of the inlet device with respect to the opening 94, and the dividing plate 120 may be disposed in the duct 76. The same components as those of the first embodiment are denoted by identical reference numerals, and the description is omitted.

Figure 13:
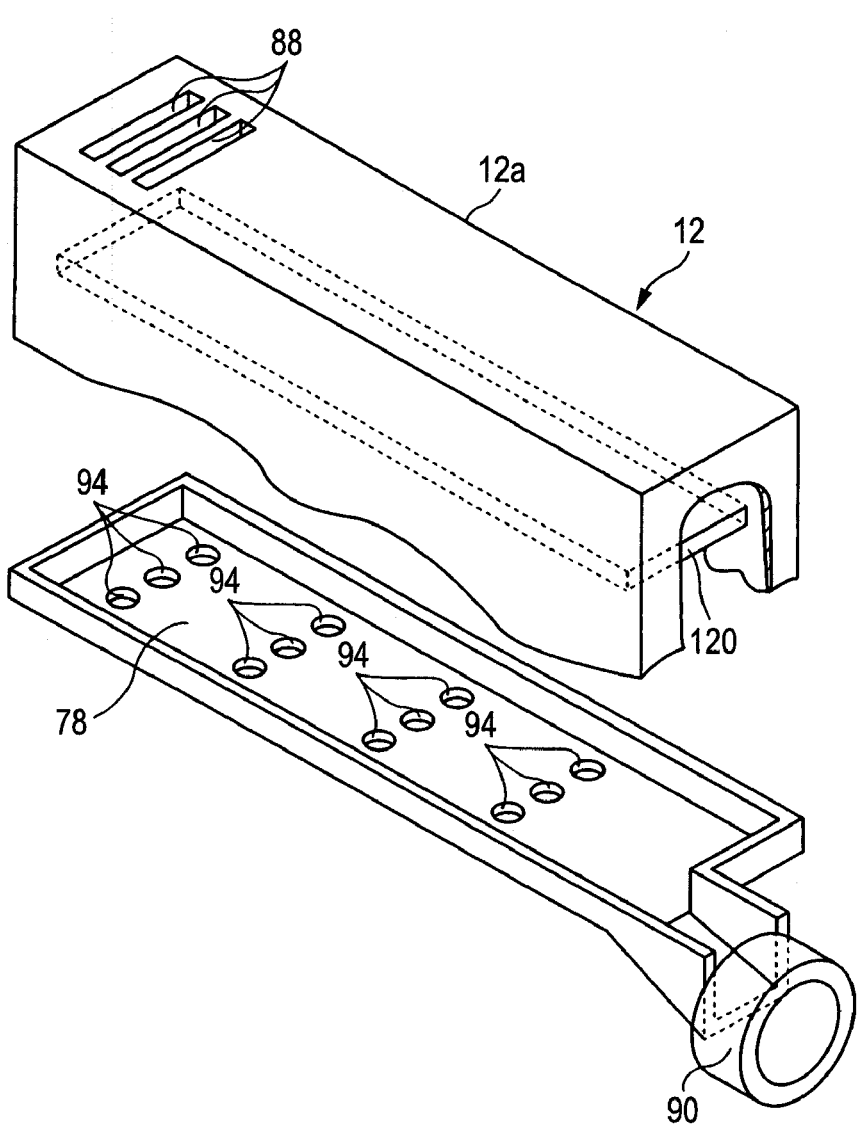
FIG. 13 is an exploded perspective view illustrating a configuration in which a duct is formed in a sixth embodiment of the invention.
Figure 14:
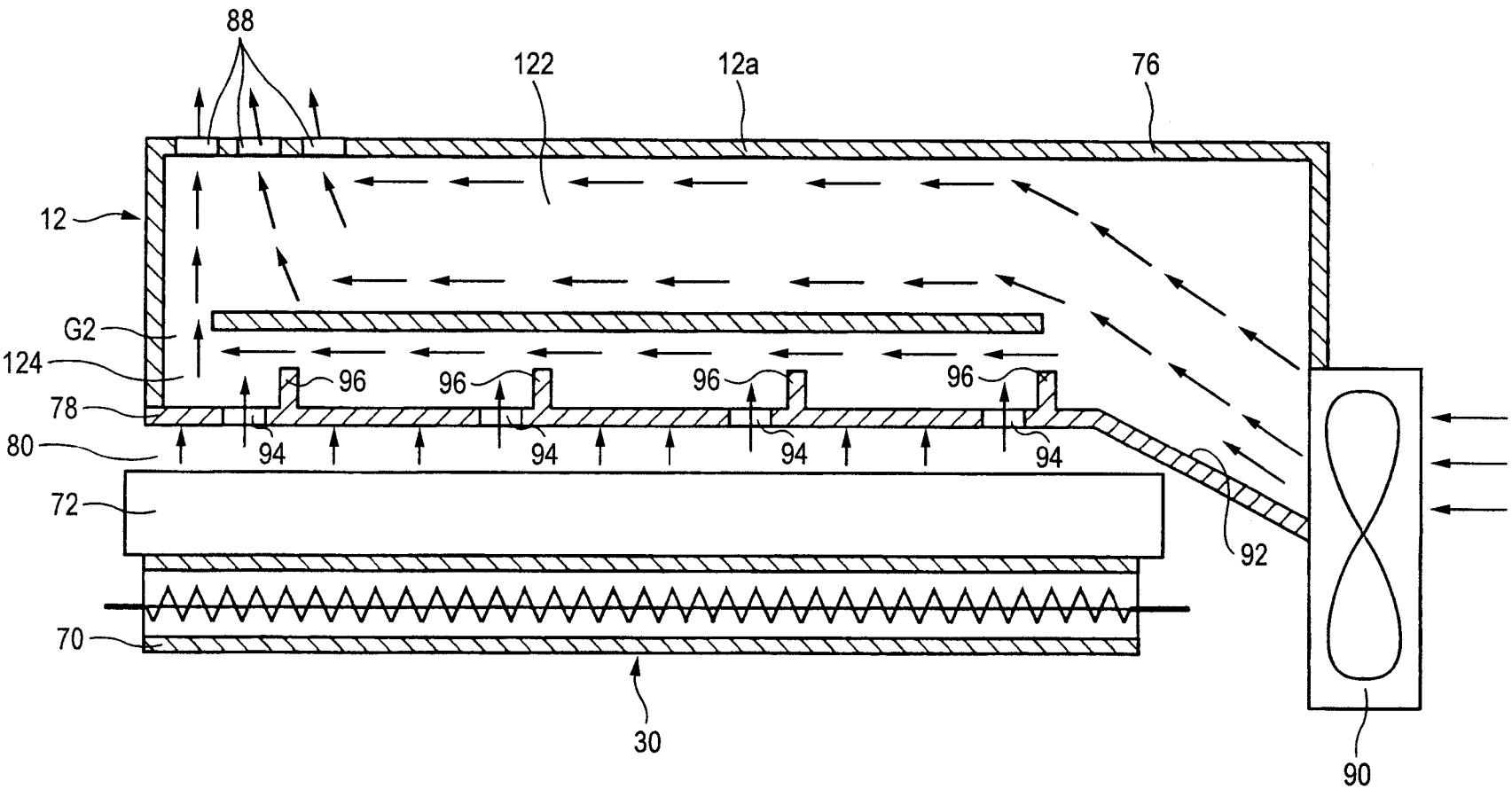
FIG. 14 is a section view showing a ventilating path used in the sixth embodiment of the invention.

FIGS. 13 and 14 show a duct 76 which is used in a sixth embodiment of the invention. In the above-described fifth embodiment, the dividing plate 120 is disposed in a substantially vertical direction in the duct 76, and the first ventilating path 122 is formed on the front side and the second ventilating path 124 is formed on the back side. By contrast, in the sixth embodiment, a dividing plate 120 is disposed substantially horizontally in the duct 76. A first ventilating path 122 is formed on the upper side, i.e., on the side of the upper cover 12*a*, and a second ventilating path 124 is formed on the lower side, i.e., on the side of the fixing device 30.

For example, the dividing plate 120 is disposed in the upper cover 12*a* with being supported by a front inner side face and a back inner side face. A gap G2 is formed between a left end portion of the dividing plate and the upper cover 12*a*. Via the gap G2, the second ventilating path 124 and the first ventilating path 122 are communicated with each other. The dividing plate 120 is disposed in the duct 76 in such a manner that the amount of air flowing through the first ventilating path 122 is larger than that flowing through the second ventilating path 124. Specifically, a relatively larger part of the air taken by the inlet device 90 is guided along the slope 92 so as to flow into the first ventilating path 122, and a relatively smaller part of the air taken by the inlet device 90 is caused to flow into the second ventilating path 12 by moving around to the lower side of the dividing plate 120.

In the same manner as the fifth embodiment, openings 94 are formed so that the second ventilating path 124 is communicated with the space 80 on the side where the fixing device 30 is disposed. The first ventilating path 122 is not communicated with the space on the side where the fixing device 30 is disposed.

In the thus configured sixth embodiment, the air flowing through the first ventilating path 122 cools the upper cover 12*a*, and the air flowing through the second ventilating path 124 causes the heat generated by the fixing device 30 and moved to the second ventilating path 124 via the openings 94 to be discharged to the outside of the image forming apparatus body 12 via the gap G2 and the discharge opening 88. In this case, in the same manner as the above-described fifth embodiment, the amount of air flowing through the second ventilating path 124 is smaller as compared with the case where the dividing plate 120 is not disposed, and than that flowing through the first ventilating path 122. Accordingly, the air flow of the air heated by the fixing device 30 via the openings 94 is hardly impeded.

In the same manner as the fifth embodiment, the sixth embodiment may be combined with at least one or more of the above-described first to fourth embodiments. When the fifth embodiment is combined with the first embodiment, for example, the walls 96 may be disposed on the side of the inlet device of the openings 94, and the dividing plate 120 may be disposed in the duct 76. The same portions as those of the first embodiment are denoted by identical reference numerals, and their description is omitted.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An aerator comprising:

a ventilating member that is disposed opposedly to a heat generating object, and that allows air to flow through an inside; and an inlet device that takes in air from an outside, and that sends the air to the ventilating member, the ventilating member including:

a discharging portion that discharges the air flowing through the ventilating member to the outside;

an opening through which heat generated by the heat generating object is taken in the ventilating member; and a restraining portion that restrains the air taken in by the inlet device from flowing to the heat generating object through the opening, wherein the restraining portion comprises a dividing portion that divides an interior of the ventilating member into a first ventilating path and a second ventilating path, wherein the air taken in by the inlet device is divided by the dividing portion such that more of the air taken in by the inlet device flows through the first ventilating path than the second ventilating path, and wherein the opening is disposed in the second ventilating path.

2. The aerator as claimed in claim 1, further comprising:

a control portion that controls the heat generating object and the inlet device to start the inlet device to be driven in response to a stop of heat generation by the heat generating object, and drive the heat generating object in a condition where the inlet device is stopped.

3. The aerator as claimed in claim 1, wherein the air flows through the ventilating member in a ventilating direction, wherein the dividing portion extends in the ventilating direction, and wherein the dividing portion separates that first ventilating path from the second ventilating path in a direction which is perpendicular to the ventilating direction.

4. An aerator comprising:

a ventilating member that is disposed opposedly to a heat generating object, and that allows air to flow through an inside; and an inlet device that takes in air from an outside, and that sends the air to the ventilating member, the ventilating member including:

a discharging portion that discharges the air flowing through the ventilating member to the outside;

an opening through which heat generated by the heat generating object is taken in the ventilating member; and a restraining portion that restrains the air taken in by the inlet device from flowing to the heat generating object through the opening, wherein the restraining portion is constituted as a moving portion that is pushed by the air taken in by the inlet device to be moved in a direction in which the opening is closed.

5. An image forming apparatus comprising:

an image forming apparatus body;

a fixing device that is accommodated in the image forming apparatus body, and that fixes an image on a recording medium by means of at least heat; and an aerator that is disposed between the image forming apparatus body and the fixing device, and the aerator including:

a ventilating member that is disposed opposedly to the fixing device, and that allows air to flow through an inside; and an inlet device that takes in air from an outside, and that sends the air to the ventilating member, the ventilating member including:

a discharging portion that discharges the air flowing through the ventilating member to the outside;

an opening through which heat generated by the heat generating object is taken in the ventilating member; and a restraining portion that restrains the air taken in by the inlet device from flowing to the heat generating object through the opening, wherein the restraining portion comprises a wall raised from a periphery of the opening.

6. The image forming apparatus as claimed in claim 5, wherein the air flows through the ventilating member in a ventilating direction, wherein the inlet device is a fan, and wherein the fan is disposed upstream from the opening in the ventilating direction.

7. An aerator comprising:

a ventilating member that opposes a heat generating object and through which air is allowed to flow; and an inlet device that takes in air from an outside and that sends the air to the ventilating member, the ventilating member comprising:

a discharging portion that discharges the air flowing through the ventilating member to the outside;

an opening through which heat generated by the heat generating object is taken into the ventilating member, wherein the air flows through the ventilating member in a ventilating direction, and wherein a slope is formed in an edge portion of the opening, said edge portion being located at a downstream end of the opening in the ventilating direction.

* * * * *